US007503757B2

(12) United States Patent
Ono et al.

(10) Patent No.: US 7,503,757 B2
(45) Date of Patent: Mar. 17, 2009

(54) OIL PUMP HAVING ROTOR RECEIVING PORTION FOR RESTRICTION MOVING RANGE OF AN OUTER ROTOR IN A DIRECTION PERPENDICULAR TO AN ECCENTRIC DIRECTION

(75) Inventors: Hisashi Ono, Aichi-Ken (JP); Koji Nunami, Gifu-Ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/935,053

(22) Filed: Nov. 5, 2007

(65) Prior Publication Data

US 2008/0107557 A1 May 8, 2008

(30) Foreign Application Priority Data

Nov. 7, 2006 (JP) ..... 2006-301986

(51) Int. Cl.
*F04C 2/00* (2006.01)
*F04C 18/00* (2006.01)

(52) U.S. Cl. ..... 418/171; 418/107; 418/108

(58) Field of Classification Search ..... 418/107–109, 418/166, 171, 61.3

See application file for complete search history.

(56) References Cited

U.S. PATENT DOCUMENTS 4,976,595 A * 12/1990 Taniguchi ..... 418/171
5,472,329 A * 12/1995 Maynard et al. ..... 418/166
6,024,550 A 2/2000 Miyazaki et al.

FOREIGN PATENT DOCUMENTS

JP 63195391 A * 8/1988 ..... 418/171
JP 03017188 1/1991
JP 10-077973 3/1998
JP 2006299846 11/2006

* cited by examiner

*Primary Examiner*—Theresa Trieu
(74) *Attorney, Agent, or Firm*—Darby & Darby P.C.

(57) ABSTRACT

An oil pump includes a housing including a rotor receiving portion at an inner side and an inner rotor accommodated in the rotor receiving portion formed at the housing. The inner rotor includes a plurality of outer teeth sequentially arranged at an outer peripheral side and integrally rotating about a first rotational center with a drive shaft. An outer rotor is also accommodated in the rotor receiving portion and includes a plurality of inner teeth sequentially arranged at an inner peripheral side, the outer rotor rotating about a second rotational center eccentric relative to the first rotational center by a predetermined amount in relation to rotations of the inner rotor in such a manner that the inner teeth and the outer teeth engage with each other. A restriction portion restricts an operating range of the outer rotor in a direction perpendicular to an eccentric direction.

2 Claims, 2 Drawing Sheets

OIL PUMP HAVING ROTOR RECEIVING PORTION FOR RESTRICTION MOVING RANGE OF AN OUTER ROTOR IN A DIRECTION PERPENDICULAR TO AN ECCENTRIC DIRECTION

CROSS REFERENCE TO RELATED APPLICATIONS

This application is based on and claims priority under 35 U.S.C. § 119 to Japanese Patent Application No. 2006-301986, filed on Nov. 7, 2006, the entire content of which is incorporated herein by reference.

FIELD OF THE INVENTION

This invention generally relates to an oil pump.

BACKGROUND OF THE INVENTION

A so-called trochoid pump is generally used as an oil pump for lubricating an internal combustion engine for an automobile, for example.

An oil pump disclosed in Japanese Patent No. JP10-77973A, which is hereby incorporated by reference in its entirety herein, includes an inner rotor, which is accommodated in a rotor receiving portion formed at an inner side of a housing and to which rotations of a drive shaft is transmitted via a pair of extending portions that are formed at a bearing bore where the drive shaft is fitted and that extend in a radially inward direction so as to face each other. In addition, the oil pump includes an outer rotor accommodated in the rotor receiving portion in such a way that the outer rotor is rotatable in relation to the rotation of the inner rotor about a rotational center eccentric relative to a rotational center of the inner rotor by a predetermined amount. The outer rotor includes multiple inner teeth engaging with multiple outer teeth formed at the inner rotor to thereby define multiple pump chambers therebetween. Then, protruding portions are formed at one side of the respective extending portions of the inner rotor so as to extend in an axial direction and to be inserted into an inner bore of the housing. A length or diameter between outer peripheral surfaces of the respective protruding portions is defined in such a way that the protruding portions are prevented from making slidably contact with the inner bore of the housing at a time of rotations of the inner rotor. As a result, the assembly performance of the inner rotor relative to the housing can be ensured without an increase of sliding loss at a time of rotations of the inner rotor.

According to the oil pump disclosed in JP10-77973A, a positioning of the inner rotor is conducted by defining a clearance as small as possible between an inner surface of the bearing bore and an outer surface of the drive shaft. Then, due to a clearance formed between an inner surface of the rotor receiving portion where the outer rotor is accommodated, and an outer surface of the outer rotor, a possible run-out of the drive shaft that is caused by a vibration of an engine, and the like, can be absorbed.

For example, the rotational center of the outer rotor is defined to be eccentric relative to the rotational center of the inner rotor on a plump line thereof by a predetermined amount. Then, the outer rotor receives a load such as driving force transmitted from the inner rotor and hydraulic pressure of operational oil. In such a structure, in the cases where the driving force is large, the outer rotor is biased to one side in a horizontal direction, for example. In addition, in the cases where the hydraulic pressure is high, the outer rotor is biased to the other side in the horizontal direction, for example. Accordingly, when the load biasing the outer rotor in directions opposite from each other occurs simultaneously and frequently, a run-out of the outer rotor occurs frequently within the clearance defined between the inner surface of the rotor receiving portion and the outer surface of the outer rotor. At this time, a hitting sound such as clanking is generated between the inner teeth of the outer rotor and the outer teeth of the inner rotor.

Thus, a need exists for an oil pump which is not susceptible to the drawbacks mentioned above.

SUMMARY OF THE INVENTION

According to an aspect of the present invention, an oil pump includes a housing including a rotor receiving portion at an inner side, an inner rotor accommodated in the rotor receiving portion formed at the housing, the inner rotor including a plurality of outer teeth sequentially arranged at an outer peripheral side and integrally rotating about a first rotational center with a drive shaft, an outer rotor accommodated in the rotor receiving portion and including a plurality of inner teeth sequentially arranged at an inner peripheral side, the outer rotor rotating about a second rotational center eccentric relative to the first rotational center by a predetermined amount in relation to rotations of the inner rotor in such a manner that the inner teeth and the outer teeth engage with each other, and a restriction portion restricting an operating range of the outer rotor in a direction perpendicular to an eccentric direction that is defined by a line connecting the first rotational center and the second rotational center.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION OF THE INVENTION

An embodiment of the present invention will be explained with reference to the attached drawings. According to the present embodiment, a trochoid pump is used as an oil pump for lubricating an internal combustion engine for an automobile, for example.

Figure 1:
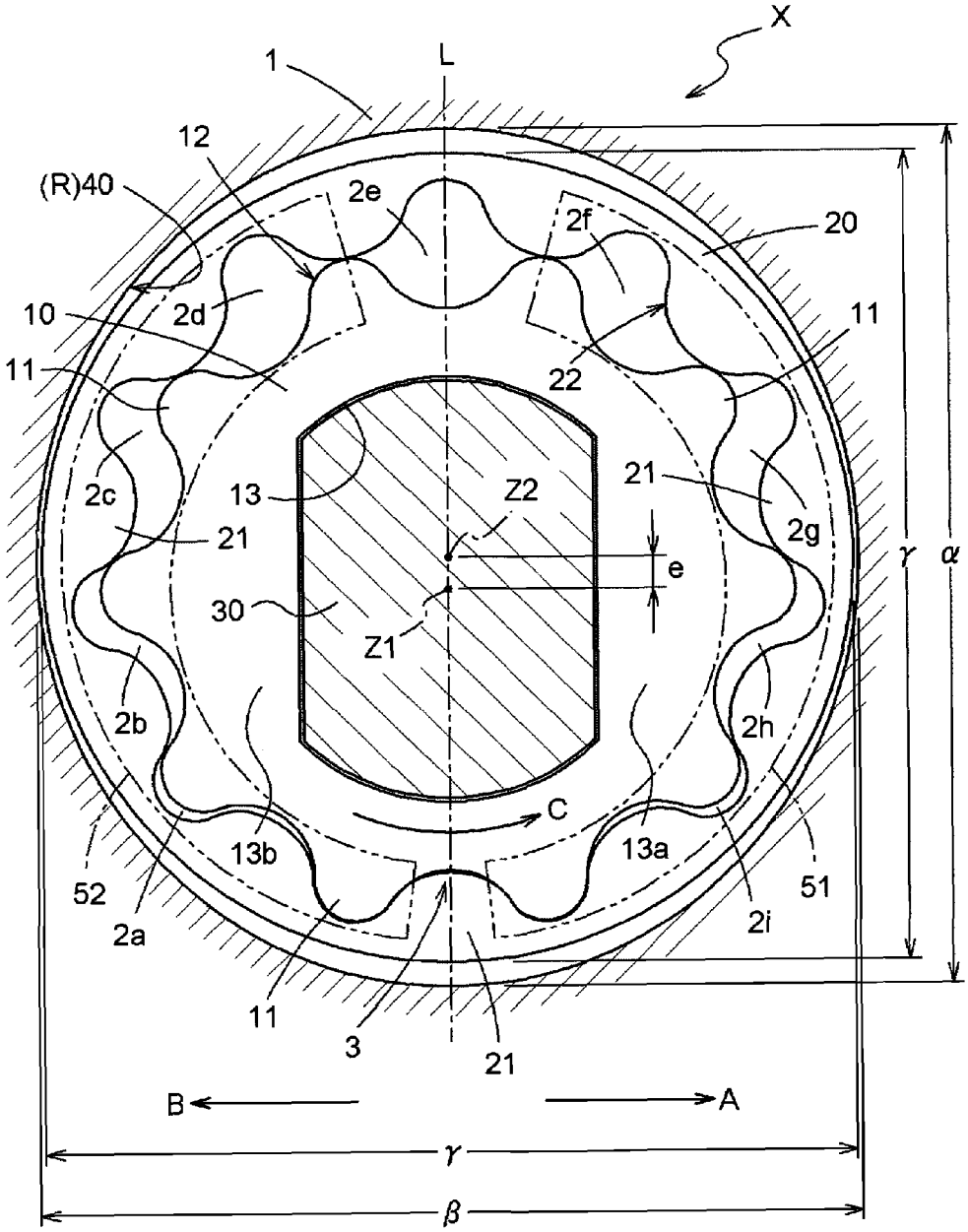
FIG. 1 is a schematic view of a main portion of an oil pump according to an embodiment of the present invention.

As illustrated in FIG. 1, an oil pump X includes an inner rotor 10 and an outer rotor 20 both accommodated in a rotor receiving portion 40 formed at an inner side of a housing 1.

The inner rotor 10 includes a bearing bore 13 at a center to which a drive shaft 30 is fitted. A clearance formed between an inner surface of the bearing bore 13 and an outer surface of the drive shaft 30 (i.e., crank clearance, which is acquired by subtracting an outer diameter of the drive shaft 30 from an outer diameter of the bearing bore 13) is generally defined to be small. Accordingly, the drive shaft 30 is received into the bearing bore 13 to thereby simplify a center alignment of the inner rotor 10 relative to the drive shaft 30.

A pair of extending portions 13*a* and 13*b* each having a semilunar shape are provided in the vicinity of the bearing bore 13 in such a manner to extend in a radially inward direction and to face each other. Rotations of the drive shaft 30 are transmitted to the inner rotor 10 through the extending portions 13*a* and 13*b*. The inner rotor 10 includes multiple outer teeth 11 sequentially arranged in a circumferential direction at an outer teeth portion 12. The inner rotor 10 integrally rotates about a first rotational center Z1 with the drive shaft 30. A rotational center of the drive shaft 30 matches the first rotational center Z1. The revolutions of the inner rotor 10 may be specified to be from 600 rpm to 7000 rpm, for example.

The outer rotor 20 includes multiple inner teeth 21 sequentially arranged in a circumferential direction at an inner teeth portion 22. The outer rotor 20 rotates about a second rotational center Z2 eccentric relative to the first rotational center Z1 by a predetermined amount in relation to rotations of the inner rotor 10 in such a manner that the inner teeth 21 and the outer teeth 11 engage with each other. A clearance formed between each tip end of the inner teeth 21 and each tip end of the outer teeth 11 (i.e., tip clearance) is generally specified to be small. According to the present embodiment, the second rotational center Z2 is configured to be vertically eccentric relative to the first rotational center Z1 by a predetermined amount "e". A direction of eccentricity of the second rotational center Z2 relative to the first rotational center Z1, i.e., a direction specified by a line connecting the first rotational center Z1 and the second rotational center Z2, is defined to be an eccentric direction. The eccentric direction is shown along an axial line L in FIG. 1 according to the present embodiment as shown in FIG. 1.

An inlet port 51 and an outlet port 52 are substantially symmetrically arranged with respect to each other relative to the axial line L that connects a pump chamber 2*e* having a maximum volume among multiple pump chambers 2*a* to 2*i*, and an engagement portion 3. When the inner rotor 10 rotates in a direction denoted by the arrow C by means of the drive shaft 30, respective volumes of the pump chambers 2*a* to 2*i* formed between the inner teeth 21 and the outer teeth 11 are changed so that operating oil is suctioned from the inlet port 51 and discharged from the outlet port 52.

A rotor receiving portion 40 accommodates the inner rotor 10 and the outer rotor 20. A clearance is formed between an inner surface of the rotor receiving portion 40 and an outer surface of the outer rotor 20 (i.e., body clearance, which is acquired by subtracting an outer diameter (γ) of the outer rotor 20 from an inner diameter (α) of the rotor receiving portion 40 in the eccentric direction).

The outer rotor 20 receives a load such as driving force transmitted from the inner rotor 10 and hydraulic pressure of the operating oil. In the case of the large driving force, the outer rotor 20 is biased towards one side of a direction perpendicular to the eccentric direction, for example (i.e., arrow A in FIG. 1). On the other hand, in the cases of the high hydraulic pressure, the outer rotor 20 is biased towards the other side of the direction perpendicular to the eccentric direction, for example (i.e., arrow B in FIG. 1). Accordingly, when the load resulting from the driving force and the hydraulic pressure for biasing the outer rotor 20 in opposite directions from each other is simultaneously and frequently applied to the outer rotor 20, a run-out of the outer rotor 20 occurs within the body clearance specified between the inner surface of the rotor receiving portion 40 and the outer surface of the outer rotor 20.

According to the present embodiment, restriction means R (restriction portion) is provided for restricting an operating or moving range of the outer rotor 20 in the direction perpendicular to the eccentric direction specified by the line connecting the first rotational center Z1 and the second rotational center Z2. As a particular embodiment of the restriction means R, the rotor receiving portion 40 is configured as below. That is, the rotor receiving portion 40 and the outer rotor 20 are formed or configured so as to satisfy an equation 1 below.

$$\alpha > \beta \geqq \gamma \qquad [1]$$

Wherein α is an inner diameter of the rotor receiving portion 40 in the eccentric direction, β is an inner diameter of the rotor receiving portion 40 in the direction perpendicular to the eccentric direction, and γ is an outer diameter of the outer rotor 20.

As a result, the inner diameter β of the rotor receiving portion 40 in the direction perpendicular to the eccentric direction is defined to be smaller than the inner diameter α of the rotor receiving portion 40 in the eccentric direction to thereby achieve the rotor receiving portion 40 having a shape with a smaller diameter in the direction perpendicular to the eccentric direction. Further, the inner diameter β is defined to be equal to or greater than the outer diameter γ of the outer rotor 20 so that the outer rotor 20 can be accommodated within the rotor receiving portion 40.

Accordingly, when a force is applied for biasing the outer rotor 20 in the direction perpendicular to the eccentric direction, the outer surface of the outer rotor 20 immediately makes contact with the inner surface of the rotor receiving portion 40 in the cases where the outer surface of the outer rotor 20 and the inner surface of the rotor receiving portion 40 are positioned extremely close to each other (i.e., β>γ). In addition, in the cases where the outer surface of the outer rotor 20 and the inner surface of the rotor receiving portion 40 are in contact with each other (i.e., β=γ), the run-out of the outer rotor 20 in the direction perpendicular to the eccentric direction is securely prevented.

Even when the run-out of the outer rotor 20 is most likely to occur, the operating range of the outer rotor 20 is restricted to thereby prevent the run-out of the outer rotor 20. In this case, a collision energy generated upon contact between the inner teeth 21 of the outer rotor 20 and the outer teeth 11 of the inner rotor 10 is reduced. Thus, even when a hitting sound is generated due to the contact between the inner teeth 21 and the outer teeth 11, that hitting sound can be minimized.

For example, the inner diameter α of the rotor receiving portion 40 in the eccentric direction is configured to be 80.00 mm to 80.02 mm, the inner diameter β of the rotor receiving portion 40 in the direction perpendicular to the eccentric direction is configured to be 79.73 mm to 79.75 mm, the outer diameter γ of the outer rotor 20 is configured to be 79.70 mm to 79.72 mm. In this case, the run-out of the outer rotor 20 in the direction perpendicular to the eccentric direction falls into a range from 0.010 mm to 0.050 mm.

According to the present embodiment, the restriction means R is provided for restricting the operating range of the outer rotor 20 in the cases where a force is applied for biasing the outer rotor 20 in the direction perpendicular to the eccentric direction. Even when the operating range of the outer rotor 20 is restricted in such a manner, the inner rotor 10 and the outer rotor 20 are smoothly rotatable within the inside of the rotor receiving portion 40, which will be explained below in details.

Figure 2:
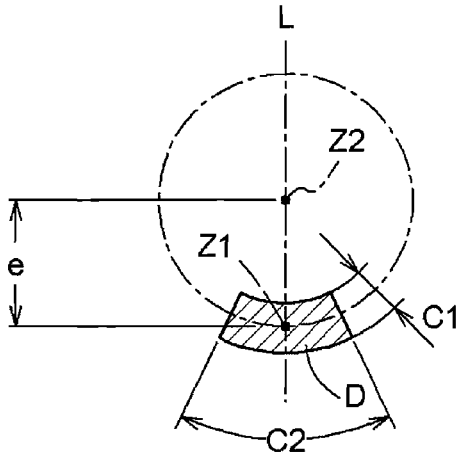
FIG. 2 is a diagram illustrating an operating range of a first rotational center in the cases where a second rotational center is fixed.

FIG. 2 illustrates an operating and moving range of the first rotational center Z1 of the inner rotor 10 in the cases where the second rotational center Z2 of the outer rotor 20 is fixed, i.e., the outer surface of the outer rotor 20 and the inner surface of the rotor receiving portion 40 are in contact with each other ($\beta=\gamma$) and thus the operation or movement of the outer rotor 20 is completely restricted.

As mentioned above, the second rotational center Z2 is away from the first rotational center Z1 by the predetermined amount e on the axial line L. The first rotational center Z1 moves on an arc of a circle of which a radius is equal to the predetermined amount e and of which a center matches the second rotational center Z2. At this time, by considering the tip clearance and the crank clearance, the operating range of the first rotational center Z1 is defined to be a shadowed portion, i.e., operating range, D. In FIG. 2, C1 indicates an operating range of the first rotational center Z1 defined by either the tip clearance or the crank clearance while C2 indicates an operating range of the first rotational center Z1 defined by both the crank clearance and the tip clearance.

According to the oil pump X of the present embodiment, even when the operating range of the outer rotor 20 is restricted in the direction perpendicular to the eccentric direction, the inner rotor 10 is movable within the range D to thereby achieve a smooth relative rotation between the rotors 10 and 20.

Meanwhile, an operating range of the second rotational center Z2 of the outer rotor 20 can be obtained in the same way on the assumption that the movement of the inner rotor 10 is completely restricted. At this time, the clearance that should be considered is the body clearance and the tip clearance.

According to the aforementioned embodiment, the restriction means R is constituted by the rotor receiving portion 40. However, the restriction means R is not necessarily constituted by the rotor receiving portion 40 and can be achieved by other components as long as the operating range of the outer rotor 20 is restricted in the direction perpendicular to the eccentric direction (arrows A and B). For example, in the cases where the rotor receiving portion 40 forms into a circular shape in a plan view, a restriction member may be provided within the body clearance so as to reduce the body clearance in the direction perpendicular to the eccentric direction. As a result, even when the run-out of the outer rotor 20 occurs, the operating range of the outer rotor 20 in the direction perpendicular to the eccentric direction is restricted to thereby reduce or prevent the run-out of the outer rotor 20.

Figure 3A:
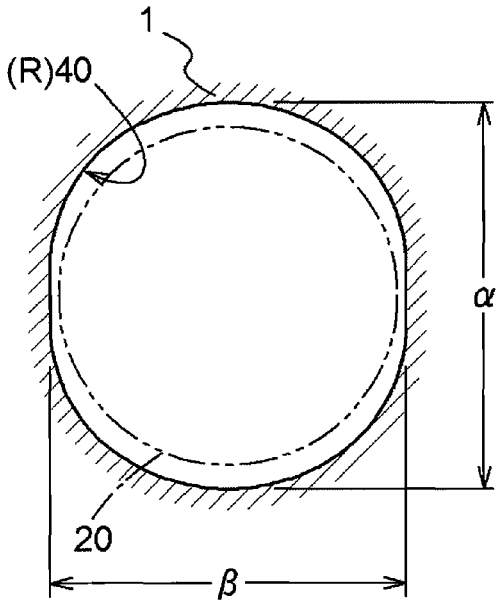
FIGS. 3A and 3B provide plan views of a rotor receiving portions according to several embodiments of the present invention.

Further, the shape of the rotor receiving portion 40 in the plan view may be specified as illustrated in FIG. 3A. That is, facing portions of the inner surface of the rotor receiving portion 40 in the direction perpendicular to the eccentric direction are each constituted by a straight line while facing portions of the inner surface of the rotor receiving portion 40 in the eccentric direction are each constituted by an arc so that the rotor receiving portion 40 forms into a racetrack shape. According to such a structure, at the time of molding an inner shape of the rotor receiving portion 40, a cutting process is performed for the straight line and the arc to thereby simplify the process. The arc may include an identical radius or be formed by a combination of multiple arcs having different radii from each other.

Figure 3B:
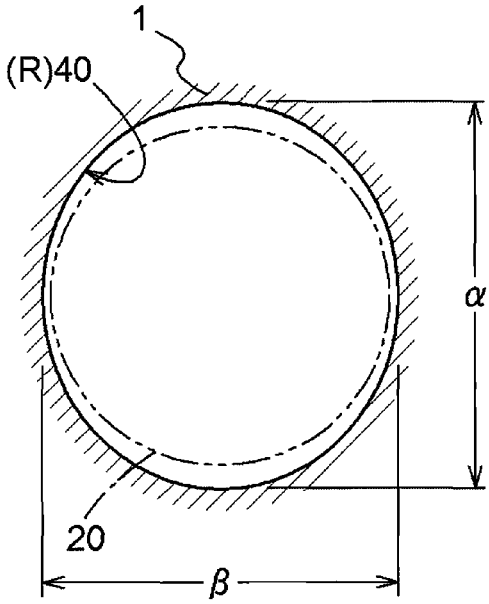

Furthermore, as illustrated in FIG. 3B, the rotor receiving portion 40 may form into an elliptic shape in which the inner diameter $\alpha$ in the eccentric direction is longer than the inner diameter $\beta$ in the direction perpendicular to the eccentric direction.

According to the aforementioned embodiment, an oil pump X includes a housing 1 including a rotor receiving portion 40 at an inner side, an inner rotor 10 accommodated in the rotor receiving portion 40 formed at the housing 1, the inner rotor 10 including a plurality of outer teeth 11 sequentially arranged at an outer peripheral side and integrally rotating about a first rotational center Z1 with a drive shaft 30, an outer rotor 20 accommodated in the rotor receiving portion 40 and including a plurality of inner teeth 21 sequentially arranged at an inner peripheral side, the outer rotor 20 rotating about a second rotational center Z2 eccentric relative to the first rotational center Z1 by a predetermined amount e in relation to rotations of the inner rotor 10 in such a manner that the inner teeth 21 and the outer teeth 11 engage with each other, and a restriction portion R restricting an operating range of the outer rotor 20 in a direction perpendicular to an eccentric direction that is defined by a line connecting the first rotational center Z1 and the second rotational center Z2.

The second rotational center Z2 of the outer rotor 20 is configured to be eccentric relative to the first rotational center Z1 of the inner rotor 10 by the predetermined amount. Then, in the cases where the load such as the driving force and the hydraulic pressure is applied to the outer rotor 20 in such a structure, the run-out of the outer rotor 20 occurs in the direction perpendicular to the eccentric direction.

In the above case, the operating range of the outer rotor 20 in the direction perpendicular to the eccentric direction is restricted by the restricting means R. As a result, even when the run-out of the outer rotor 20 is most likely to occur, the operating range thereof is restricted to thereby prevent the run-out of the outer rotor 20. At this time, a collision energy generated upon contact between the inner teeth 21 of the outer rotor 20 and the outer teeth 11 of the inner rotor 10 is reduced. Thus, even when a hitting sound is generated due to the contact between the inner teeth 21 and the outer teeth 11, that hitting sound can be minimized.

In addition, according to the aforementioned embodiment, the restriction portion R is equal to the rotor receiving portion 40, and the rotor receiving portion 40 and the outer rotor 20 form into respective shapes so as to satisfy an equation of $\alpha>\beta\geqq\gamma$ in which $\alpha$ is an inner diameter of the rotor receiving portion 40 in the eccentric direction, $\beta$ is an inner diameter of the rotor receiving portion 40 in the direction perpendicular to the eccentric direction, and $\gamma$ is an outer diameter of the outer rotor 20.

The inner diameter $\beta$ of the rotor receiving portion 40 in the direction perpendicular to the eccentric direction is defined to be smaller than the inner diameter $\alpha$ of the rotor receiving portion 40 in the eccentric direction and be equal to or greater than the outer diameter $\gamma$ of the outer rotor 20. As a result, the outer surface of the outer rotor 20 and the inner surface of the rotor receiving portion 40 can be positioned extremely close to each other, or in contact with each other.

Accordingly, the possible run-out of the outer rotor 20 resulting from the clearance formed between the outer rotor 20 and the rotor receiving portion 40 can be significantly reduced.

Further, according to the aforementioned embodiment, a shape of the rotor receiving portion 40 is defined in such a manner that facing portions of an inner surface of the rotor receiving portion 40 in the direction perpendicular to the eccentric direction are each constituted by a straight line while facing portions of the inner surface of the rotor receiving portion 40 in the eccentric direction are each constituted by an arc.

Furthermore, according to the aforementioned embodiment, the rotor receiving portion 40 forms into an elliptic shape in which the inner diameter $\alpha$ in the eccentric direction is longer than the inner diameter $\beta$ in the direction perpendicular to the eccentric direction.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and foreseeable equivalents which fall within the spirit and scope of the present invention as defined in the claims, be embraced thereby.

We claim:

1. An oil pump comprising:

a housing including a rotor receiving portion at an inner side;

an inner rotor accommodated in the rotor receiving portion formed at the housing, the inner rotor including a plurality of outer teeth sequentially arranged at an outer peripheral side and integrally rotating about a first rotational center with a drive shaft;

an outer rotor accommodated in the rotor receiving portion and including a plurality of inner teeth sequentially arranged at an inner peripheral side, the outer rotor rotating about a second rotational center eccentric relative to the first rotational center by a predetermined amount in relation to rotations of the inner rotor in such a manner that the inner teeth and the outer teeth engage with each other; and a restriction portion restricting an operating range of the outer rotor in a direction perpendicular to an eccentric direction that is defined by a line connecting the first rotational center and the second rotational center, wherein a shape of the rotor receiving portion is defined in such a manner that facing portions of an inner surface of the rotor receiving portion in the direction perpendicular to the eccentric direction are each constituted by a straight line while facing portions of the inner surface of the rotor receiving portion in the eccentric direction are each constituted by an arc.

2. An oil pump according to claim 1, wherein the rotor receiving portion comprises the rotor restriction portion, and the rotor receiving portion and the outer rotor form into respective shapes so as to satisfy an equation of $\alpha > \beta \geqq \gamma$ in which $\alpha$ is an inner diameter of the rotor receiving portion in the eccentric direction, $\beta$ is an inner diameter of the rotor receiving portion in the direction perpendicular to the eccentric direction, and $\gamma$ is an outer diameter of the outer rotor.

* * * * *